United States Patent [19]

Stinson

[11] 4,156,496

[45] May 29, 1979

[54] BOW-MOUNTED ARROW QUIVER

[76] Inventor: Robert E. Stinson, 7292 Peaceful Valley Rd., Acme, Mich. 49610

[21] Appl. No.: 765,115

[22] Filed: Feb. 3, 1977

[51] Int. Cl.[2] ..... F41B 5/06

[52] U.S. Cl. ..... 124/23 A; 248/221.3; 248/223.4

[58] Field of Search ..... 224/0.5, 1 R, 1 A, 113, 224/2 D, 5 R, 25 R, 25 A, 26 R, 28 R, 28 B, 26 B; 124/23 A, 24 A, 41 A, 88, 45; 248/220.2, 221.3, 222.1, 223.1, 223.4, 224.4, 225.1, 15; 211/60 R

[56] References Cited

U.S. PATENT DOCUMENTS

| | | | |
|---|---|---|---|
| 1,982,248 | 11/1934 | Gebhardt | 224/28 B X |
| 2,717,442 | 9/1955 | Smith | 224/2 D X |
| 2,908,432 | 10/1959 | Kent | 124/32 A X |
| 2,954,764 | 10/1960 | Stinson | 224/1 B X |
| 2,980,305 | 4/1961 | Reese | 124/23 A |
| 3,337,099 | 8/1967 | Rose | 224/1 B |
| 3,377,999 | 4/1968 | Reynolds | 124/88 X |
| 3,608,851 | 9/1971 | Anderson | 248/15 |
| 3,716,174 | 2/1973 | Ehlert | 224/1 B |
| 3,777,734 | 12/1973 | Rose | 224/1 B X |
| 3,840,944 | 10/1974 | Gresley | 124/23 A |
| 3,915,189 | 10/1975 | Holbrook et al. | 248/223.4 |
| 4,020,984 | 5/1977 | Morris | 224/1 B |

*Primary Examiner*—Trygve M. Blix

*Assistant Examiner*—Winston H. Douglas

*Attorney, Agent, or Firm*—Price, Heneveld, Huizenga & Cooper

[57] ABSTRACT

A bow-mounted arrow quiver includes an elongated frame, a shaft holder and support, and an arrowhead-receiving housing and shield. A compartmentalized member of resilient material having a plurality of openings or recesses therein is disposed within the housing for engaging and retaining the arrowheads in a snug and secure manner to prevent the arrows from slipping out of place or falling from the quiver, and also to prevent damage to the arrowheads while at the same time preventing any rattling or other such sounds. A mounting plate adapted for permanent securement to a bow handle or other surface cooperates with a mounting pad and latch means on the frame to releasably but positively mount the quiver to the bow. A forward stabilizing clip assembly may be included to further stabilize the mounting of the quiver. A special compartment is preferably included in the arrowhead-receiving member and contains a scent-retaining element for any of a variety of hunter's scented liquids. The shaft holder mounts to the frame between clamping elements having mating lugs which prevent overcompression of the holder which might otherwise distort the shaft-receiving portions and result in undesired loosening of the shafts.

17 Claims, 12 Drawing Figures

BOW-MOUNTED ARROW QUIVER

BACKGROUND OF THE INVENTION

This invention relates to arrow quivers and more particularly to a unique bow-mounted quiver.

Heretofore various forms of arrow quivers have been proposed which are mountable directly to a bow structure. Although providing ready access to the arrows, the use of most of these prior structures has been accompanied by various problems. For example, these quivers are usually bolted rigidly to the bow in a more-or-less permanent fashion, by the use of bolts which extend through the bow structure. As a result, the bow must have through-holes drilled in it, defacing and weakening the bow, and the user is unable to readily remove the quiver from the bow absent the use of hand tools. This problem is especially aggravated when the quiver is used on a hunting bow in field situations. Also, a broadhead arrows have become increasingly popular for use in hunting game. These arrows generally include a plurality of razor-sharp blades which extend rearwardly from the point or tip of the arrow. The number of these blades may vary from two to eight, for example, depending upon the specific type of game being hunted. When employing prior bow-mounted quiver structures with these forms of arrows, results have not been totally satisfactory. Upon removing the broadhead arrows from prior quivers, an annoying and undesired clicking noise caused by contact between the broadhead of adjacent arrows or with the quiver structure itself is produced. This clicking noise can alert the game to the presence of the hunter. Further, since contact by the razor-sharp blades is made with the quiver or with adjacent arrows, the broadhead may be damaged and the blades may become dulled or nicked.

In addition, many prior bow-mounted quiver structures have not provided adequate protection to a hunter from injury should he trip and fall on the quiver. The shield which may extend around the arrowheads has generally not provided adequate protection. In the event of a fall, the blades may cut right through the shield. Furthermore, presently-available bow-mounted quivers are not readily adaptable to a wide variety of bow designs. For example, the type of bow commonly referred to as a compound bow is now gaining wide popularity, but due to the curvature and unconventional shape of such a bow structure, and the reduced space available for mounting of a quiver, previously-known quivers have not been readily adaptable for stable mounting on the bow. Further, presently-available quivers are not readily adaptable for right or left-hand mounting, due primarily to the method of securing the quivers to the bow.

Therefore, a need exists for a bow-mounted quiver that securely supports a plurality of arrows, particularly of the broadhead-type; that is readily adaptable to a wide variety of bows including compound bows, that permits ready mounting and dismounting of the quiver from the bow without the use of hand tools; and that reduces or limits the undesirable noise and damage to the arrowheads attendant to the removal of an arrow from the quiver.

SUMMARY OF THE INVENTION

In accordance with the present invention, a unique bow-mounted quiver is provided whereby the problems heretofore experienced are substantially eliminated.

Essentially, the quiver includes an elongated molded frame member having a shaft holder and support positioned at one end thereof. An arrowhead shield is positioned at the opposite end of the frame member. Provision is made for releasably receiving each arrowhead in a secure fashion, preventing the occurrence of noise upon the removal of any one of the individual arrows from the quiver, and for preventing damage to the arrowhead upon removal from or mounting on the quiver. Further, a unique mounting bracket is provided whereby the quiver is rigidly mounted to the bow but may be selectively and rapidly released without the use of hand tools or the removal of fasteners.

DETAILED DESCRIPTION OF THE PREFERRED EMBODIMENT

Figure 1:
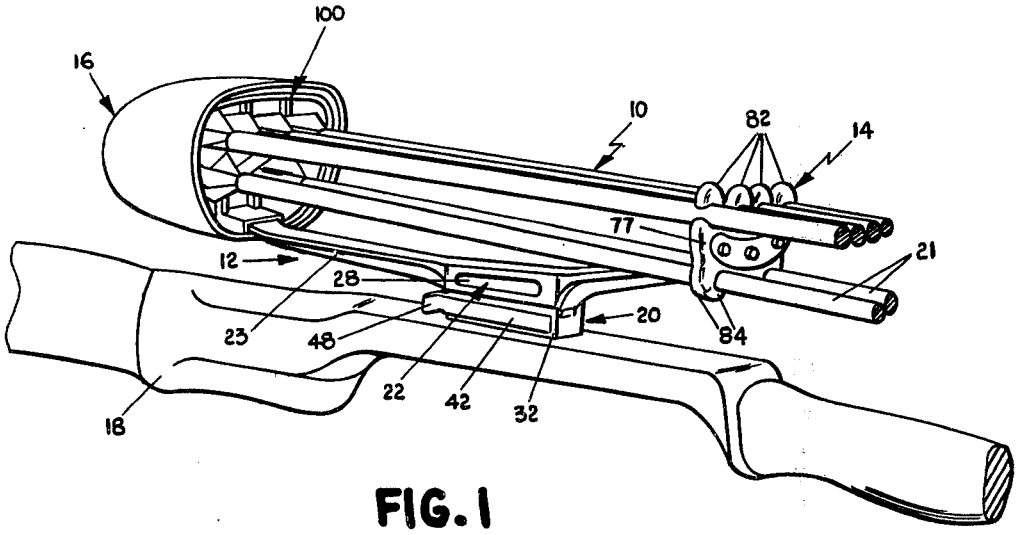
FIG. 1 is a perspective view showing a quiver in accordance with the present invention mounted on a bow.
Figure 2:
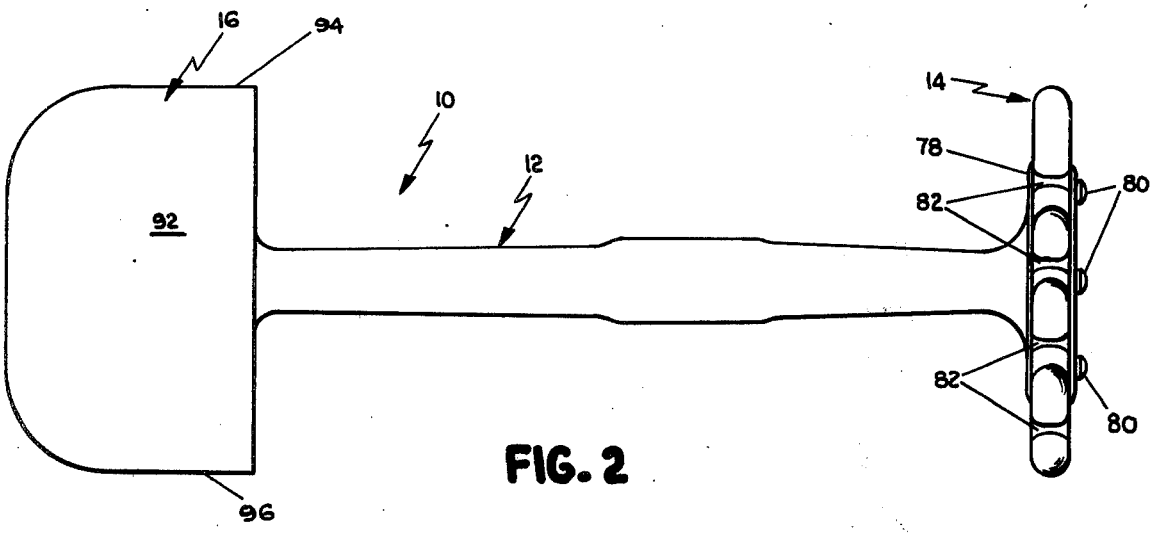
FIG. 2 is an overhead plan view of the quiver of FIG. 1, shown apart from the bow.

The unique bow-mounted quiver in accordance with the present invention is illustrated by the embodiment thereof shown in the drawings and generally designated 10. As best seen in FIGS. 1–4, the quiver includes an elongated, lightweight frame 12, preferably of molded plastic, a shaft-gripping molded vinyl arrow holder and support 14 secured to one end of the frame, and a forward-mounted arrowhead-receiving housing or shield 16. The quiver 10 is releasably mounted on a bow structure 18 by a bracket 20, as will be more fully described below. As shown, the quiver securely supports a plurality of arrows 21 for ready use by the bowman.

Figure 3:
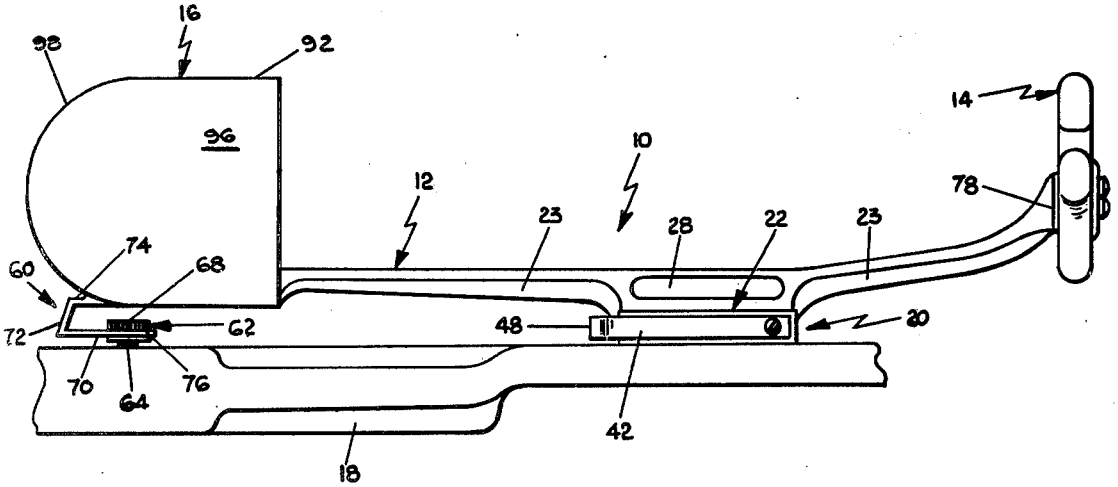
FIG. 3 is a side elevational view of the quiver as mounted on a bow, and including an alternative mounting feature.
Figure 4:
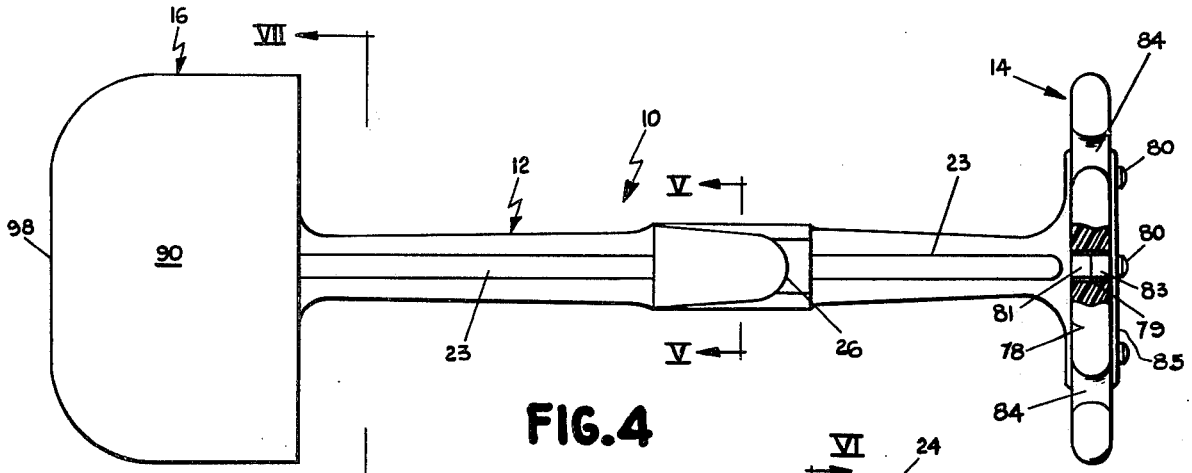
FIG. 4 is a bottom plane view of the quiver without the bow, shown partly in section to illustrate certain details.

The elongated quiver frame 12 is preferably molded as a solid, one-piece member having longitudinally-extending reinforcing ribs 23. Intermediate the ends thereof, the frame is formed with an integral, downwardly extending base 22. Internally formed therewith and extending outwardly along the lower lateral edges of the base 22 is a mounting flange 24 (FIG. 4). The flange 24 progressively narrows along its length toward an arcuate end 26. The sides of the frame in the area of the mounting base 22 may be formed with inwardly directed, longitudinally-extending depressions 28 (FIGS. 1 and 3). These depressions provide a ready gripping area for the finger tips of the user, as explained hereinafter. The frame 12 is a fairly rigid yet light-weight member, and when formed in the preferred manner (i.e., molded of plastic such as Polycarbonate) the frame will be stiffly flexible at least to some degree.

Figure 9:
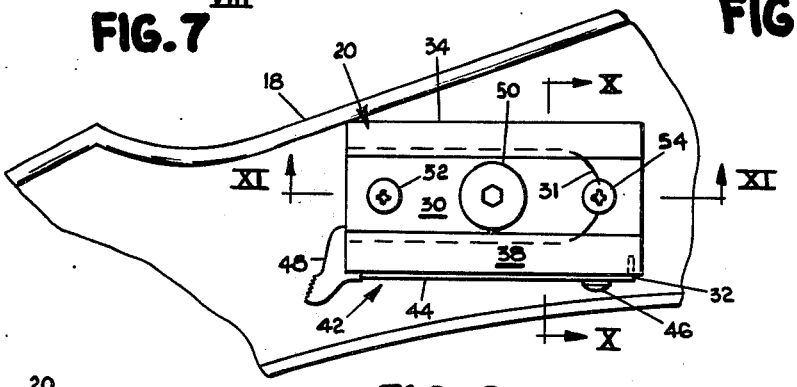
FIG. 9 is a fragmentary plan view of the bow, showing the mounting bracket structure.
Figure 11:
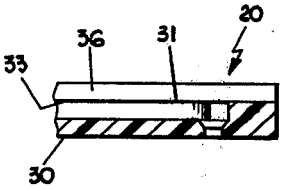
FIG. 11 is a fragmentary side elevational view of the mounting bracket, taken along the plane XI—XI of FIG. 9.

As best seen in FIGS. 1, 3 and 9, the quiver is secured to the bow by a mounting bracket, generally designated 20, which is secured to the bow and which cooperates with the mounting flange 24 on the quiver, as described below. The mounting bracket 20 has the general form of a rectangular plate, with its center recessed to provide a generally channel-shaped cross section (FIG. 10), thus including a base 30, upstanding side walls 32, 34 and inwardly directed, transversely opposed flanges 36, 38. The base, the sidewalls and the flanges define a pair of opposite side slots or channels 33 for receiving the mounting flange 24 of the frame 12. The base 30 defines a generally U-shaped seat 31, as best seen in FIG. 9, which interconnects, and closes, the side slot 33. The seat 31 is shaped to restingly receive the end of mounting flange 24 carried by the quiver. Secured to the side wall 32 of the mounting bracket 20 is a shiftable closure 42. In the preferred form the closure includes a resilient strip 44 secured at one end to the side wall of the bracket by a suitable fastener 46. The strip 44 is preferably fabricated from leaf spring material. Secured at the opposite end of the resilient strip 44 is a thumb-or finger-engageable stop 48. The stop 48 is generally wedge-shaped, and selectively closes off the open end of one of the mounting flange-receiving channels 33 (Note FIG. 9).

Figure 10:
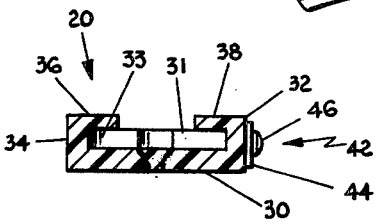
FIG. 10 is a sectional elevational view of the mounting bracket, taken along the plane X—X of FIG. 9.

As best seen in FIGS. 9 and 10, the base 30 of the mounting bracket is provided with a plurality of apertures 50, 52 and 54 which receive machine screws or other such fasteners. The bracket 20 is secured to a bow 18 at the handle rise portion by use of such screws or fasteners. Typically, the bow 18 will be provided with a pre-drilled and/or tapped passage at this location. A bolt may then be employed to secure the bracket to the bow through aperture 50. Additional threaded fasteners may be employed at apertures 52, 54 to rigidly mount the bracket. In this manner, the bracket is in effect permanently or at least semi-permanently affixed to the bow structure. Further, the bracket may be mounted on either side of the bow, readily adaptable for either right or left hand mounting.

As should be readily apparent, once the mounting bracket 20 is secured to the bow, the quiver is quickly and easily mounted by manually shifting the stop 48 outwardly against the bias of the leaf spring 44, thereby clearing the open end of the recesses 33. The mounting flange 24 may then be slipped longitudinally within the channels 33 of the bracket. Once the arcuate edge 26 of the mounting flange abuts the seat 31 at the closed end of recess 33, the stop 48 is released, thereby locking or retaining the quiver upon the bracket. As a result, the quiver 12 is securely and rigidly affixed to the bow. This mounting arrangement requires a minimum of space and permits ready removal of the quiver by merely shifting the stop member 48 and sliding the mounting flange out of the channel. Mounting removal is easily and quickly accomplished without the use of special tools or the removal of fasteners as heretorfore required.

It has been found that when the quiver of the invention is of the preferred molded plastic construction, and is secured to the handle riser of a bow in the above manner, it acts in effect as a vibration damper. The quiver dampens vibration of the bow attendant to the release of an arrow by the sympathetic and harmonic vibrations of the quiver. If the upper portion of the quiver is also secured to the bow as described below, this damping action is not as pronounced.

If further stabilizing and rigidity of the quiver mount is desired, beyond that described above, as for example if the quiver frame is of relatively high flexibility, an upper clip bracket 60 may be employed, as shown in FIG. 3. The bracket 60 includes a spool 62 affixed to the bow by a suitable fastener 64 such as a machine screw. The spool 62 includes upper and lower disc-like flanges 68, 70 and a central cylindrical portion of reduced diameter. A clip 72 secured at one end 74 to the arrow shield 16 is bifurcated at its free end 76 to engage the spool 62 by straddling its central portion. In the preferred form of the clip mount 60 just described, the bifurcated end of clip 72 cooperates with the tongue-and-groove main quiver mount, since the clip slides over the spool with the same motion which slides the mounting flange 24 into the T-slot or channel 33 of the mounting bracket. Also in the preferred embodiment of the clip bracket, the bifurcated end of the clip and the spool are both coated with plastic material. This plastic material substantially eliminates the occurrence of any noise upon mounting or dismounting of the quiver.

The arrow shaft support 14, as best seen in FIGS. 1–4, is a resiliently flexible plate-like member having a central portion 77 (FIG. 1) by which the support is secured to a rear mounting surface or shoulder 78 (FIGS. 2–4), formed integral with the frame 12. Preferably, this attachment is accomplished by providing apertures 79 (FIG. 4) through the shaft support, or holders which fit snugly over mounting lugs 81, 83 provided on the rear shoulder 78 of the frame and on the adjacent side of a back up plate 85. Each such lug protrudes outward slightly less than half the thickness of the arrow holder, or shaft support, 14. Thus, when the latter is in place and screws 80 are extended through an aperture in each of the lugs 81, 83 (threaded to receive the screws) and tightened, the shaft support is clamped in place and slightly compressed, until the ends of the two lugs meet, as illustrated. Backup plate 85 is a load bearing means and lug 83 is an abutment which engages lug 81. This limits compression of the shaft support and provides a secure attachment for the latter which if compressed an undue amount might be sufficiently distorted and/or stressed to loosen the arrows which it should frictionally grip. That is, extending along the lateral edges of the shaft support 14 are a plurality of generally C-shaped slots 82, 84. The upper slots 82 open in an inward direction towards the user of the bow as the quiver is shown mounted thereon. The slots 82 are dimensioned so as to frictionally engage or grip the shaft portions of each arrow 21, preferably with slight resilient flexing of the slot walls upon insertion of each arrow when the shaft support is firmly mounted in place and the screws 80 are tightened enough to bring the ends of the lugs 81, 83 into contact with one another. As a result of the positioning of the slots 82, the arrows may be removed from the quiver by a straight, backward motion towards the bow user. Heretofore, many bow quivers have required a sideward movement which is more awkward and increases the time required for removing an arrow and positioning it for shooting. The lower slots 84 are similarly configured, and each likewise frictionally grips or holds the shaft of an arrow.

The arrowhead-receiving housing, or broadhead shield 16 is illustrated (FIGS. 1–4, 7 and 8) as a generally concave domed oval structure including a bottom wall 90 (FIG. 4), a top wall 92 (FIG. 2), side walls 94, 96 (FIGS. 2 and 3), and an end wall 98 (FIGS. 3 and 4). In the preferred form, the housing 16 is formed from a molded plastic and the end wall 98 has a thickness at least double the thickness of the side walls or the top wall and bottom wall of the housing. By increasing the thickness of the end wall, the amount of protection provided to the bow user is substantially increased.

Figure 6:
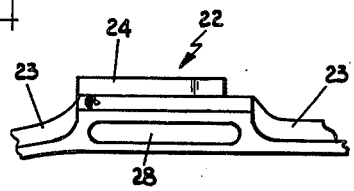
FIG. 6 is a fragmentary side elevational view showing the mounting flange, as seen along the plane VI—VI of FIG. 5.
Figure 5:
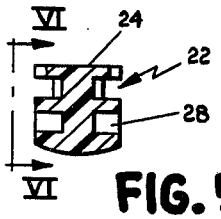
FIG. 5 is a sectional elevational view of the mounting flange, taken along the plane V—V of FIG. 4.
Figure 7:
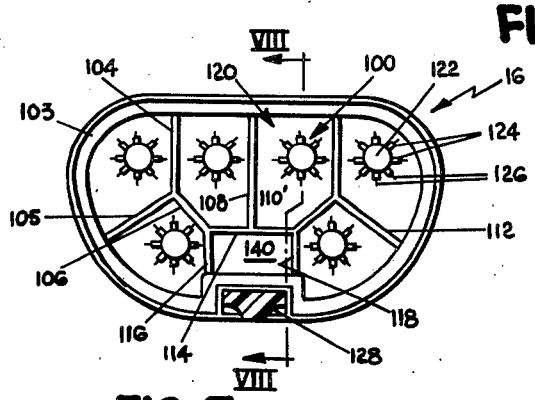
FIG. 7 is a cross-sectional end elevational view showing the arrowhead-retaining member, taken along the plane VII—VII of FIG. 4.
Figure 8:
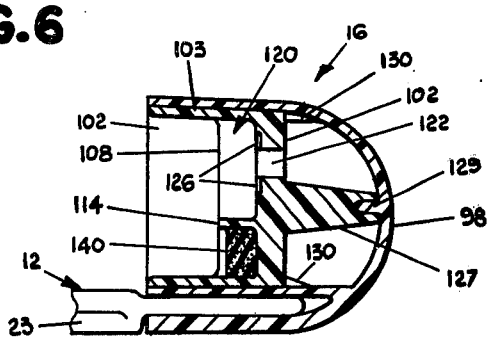
FIG. 8 is a fragmentary sectional side elevational view taken along the plane VIII—VIII of FIG. 7, showing the arrowhead-retaining member.

Disposed within the housing 16 is an arrowhead retainer 100 (FIGS. 1 and 7) which is adapted to receive and retain the tip of each arrow, most often, broadhead hunting arrows. The retainer 100 is basically a segmentally-divided flat-bottomed cup, which may be molded as an insert and secured by screws or by adhesive to the interior of the housing or shield 16. As best seen in FIGS. 7 and 8, the retainer 100 includes a rear or bottom wall 102, a peripheral, outwardly-directed wall 103, and a plurality of compartment walls 104, 105, 106, 108, 110, 112, 114, 116 and 118. Each of the interior or compartment walls may have a transverse dimension less than half that of the outer wall, as best seen in FIG. 6. The interior walls and the outer wall define a plurality of compartments 120. Each compartment is adapted to receive and retain the head of an arrow in conjunction with rear wall 102, which defines within each compartment a through-bore structure 122. Extending radially from the periphery of each bore 122 are a plurality of indexing slots 124, each extending through the wall 102. Extending outward from the bores 122 as a continuation of and in the same radial plane as the indexing slots 124 are a plurality of blade slots or recesses 126. These blade recesses extend only a short distance into the rear wall 102, from the front or accessible side thereof shown in FIG. 7.

In the preferred form, the arrowhead or tip retainer 100 is molded from thermoplastic rubber and the tip-receiving bore structures 122 each include a minimum of eight pre-molded, equally-spaced, radially-directed slot formations 124, 126. The retainer is therefore adapted to accept arrowheads with any style point presently available, including not only a plain pointed tip but all of the commonly-known broadhead points. When placing an arrow onto the quiver for the first time, the user will first place the shaft into one of the shaft-receiving slots 82, 84 in the lower support 14. The arrowhead portion is then moved upwardly until the tip just enters a corresponding through-bore 122, each of which is in alignment with one of the shaft-receiving slots 82, 84. The shaft is then rotated until the blades of the head come into alignment with, and are received within, the slots 124, thereby indexing the blade for proper positioning. The arrow is then driven or pushed forward whereupon the blades of a broadhead point or tip cut into the rear wall 102 in line with and as an extension of the slots 126. In this manner, the blades will cut at least a portion of their own slits or indexing slots 124, the walls of which frictionally engage the blades. The compartment walls 104, 105, etc., prevent inadvertent contact between adjacent arrowheads upon removal or placement on the quiver, and help guide the arrowheads into their respective bore structures 122. This eliminates noise problems and prevents damage to the razor-like blades. After the initial insertion of arrows, when arrows are subsequently mounted on the quiver in repeated use, the shaft is rotated until the appropriate indexing slots are engaged and then pushed forward into the previously-cut slits, where the blades are engaged or gripped by the rear wall of the retainer.

The retainer 100 also preferably includes one or more forwardly-extending bosses 127 (FIG. 8), which may be molded integrally with rear wall 102. These bosses are adapted to engage lugs 129 formed on the inner face of shield wall 98, as by a snap-fit socket arrangement. This attachment method is illustrated in FIG. 8. When such an attachment is used, it is to be noted that other means for securing the retainer into the shield may not be necessary, particularly if a friction fit is provided around the periphery where these parts fit together. It should be noted that, as illustrated in FIG. 8, the shield 16 also preferably includes a number of integrally-molded indexing lugs or stops 130, which serve to position the retainer 100 in place within the shield in the desired place and orientation (together with the lugs 129, mentioned above). As illustrated, the positioning lugs 130, of which there are preferably at least four, and as many as eight, or more, are small protrusions from the interior wall of shield 16 which have flat, co-planar ends disposed generally perpendicular to the side walls of the shield. When fully in place, the bottom surface of bottom wall 102 of the retainer directly abut the flat co-planar ends of the positioning lugs, thereby seating the retainer within the shield in proper position. This also cooperates with the engagement lugs 129 and the bosses 127 with which they mate, to readily provide proper alignment thereof as the retainer is pushed into place within the shield.

A further feature of the retainer 100 is to provide a ready place for positioning an element 140 (FIG. 7), which may be a sponge or like pad, treated or impregnated with animal-attracting scent. As illustrated, element 140 is positioned within a compartment defined by walls 114, 116 and 118. Various types of such animal scent is readily available in a spray or liquid form, and is a known method of attracting game or concealing the scent of the hunter. It is particularly useful to have a self-contained source of such scent with the hunter's equipment, however, so that the hunter need not spray the scent on his clothing or equipment each time he hunts, a condition which is not only bothersome and tedious (and therefore likely to be neglected), but which also leaves the hunter's clothing with a residual odor which is likely to be objectionable to others, will cause non-hunters to look askance at the hunter and to conjecture, at times sarcastically, as to the source of the odor. Furthermore, having a self-contained source of the scent with the hunter's equipment helps mask the scent of the equipment, including the quiver itself, particularly where molded plastics are used, which have a characteristic and somewhat penetrating smell. Of course, the sponge or other element 140 may be replaced as necessary, as well as treated repeatedly.

The unique quiver structure may be molded as a single, one-piece unit or, in the alternative, the frame 12, the shaft support 14, shield 16 and retainer 100 may be molded as individual pieces, and subsequently assembled. The shield 16 may be molded with a frame-receiving opening 128 (FIG. 7) integral with the bottom wall of the housing. The end of the frame is inserted within this portion and secured with a suitable adhesive. By forming the quiver from a relatively lightweight, semi-rigid plastic material, the weight of the quiver is reduced from that of previous quivers. By employing the semi-permanently or permanently secured bracket 20 to secure the quiver to the bow, the overall mounting is relatively rigid and quite stable; with the use of the forward clip-like bracket 60 rigidity is increased. The quiver is thus mounted upon or released from the bow without the use of screws, bolts, wing nuts or other such fastening arrangements. The mounting bracket also readily adapts the quiver for mounting upon any support structure, such as a blind, post or any surface capable of supporting the bracket. This allows the hunter to mount the quiver within ready reach when hunting from a fixed location, without having the arrows carried on the bow while actively hunting and shooting, and yet permits easy and fast detachment of the quiver and arrows from such a support and reattachment thereof to the bow when the hunter wishes to leave, or to hunt on foot.

Figure 12:
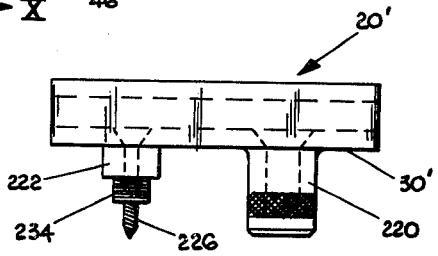
FIG. 12 is a side elevational view illustrating an alternative form of the bracket for attaching the quiver to a bow.

As best seen in FIG. 12, an alternative mounting bracket 20' may be employed on bows having handle risers with many compound curves and no flat spots opposite the sight window where the regular base or mounting bracket would be installed. As shown, the bracket 20' is formed with a projection or boss 220 integral with the base 30° of the bracket. An aperture or hole drilled in the bottom of the bow handle receives the boss 220. Longitudinally spaced from the boss 220 is an internally threaded boss 222. Received within the boss 222 is an externally threaded, hollow stud-like member 234. A machine screw or other such fastener 226 extends through the central passage within hollow stud 234 to secure the bracket 20' to the bow handle. The proper positioning of the quiver parallel to the bow may be easily obtained by adjustment of the stud 234 within the boss 222 i.e., threading the stud further in or out so that its outer end abuts the bow handle at the desired location where a tapped hole has been formed, with the end of boss 220 contacting the bow handle at its respective spaced position. Then the machine screw 226 is then threaded into the tapped hole in the bow handle, and the main projection boss 220 may be secured in place by an epoxy-type adhesive.

Therefore, it can be seen that the unique quiver arrangement in accordance with the present invention securely supports a plurality of arrows for ready use, permits ready release of the quiver from the bow or other support without the use of hand tools or removal of fasteners and further, reduces the noise incident to removal of an arrow and protects the arrowheads from damage. It is expressly intended, however, that the above description should be considered as that of the preferred embodiment. The true spirit and scope of the present invention will be determined by reference to the appended claims.

The embodiments of the invention in which an exclusive property or privilege is claimed are defined as follows.

1. A quiver mountable on a bow for holding a plurality of arrows, particularly of the broadhead-type, comprising:

an elongated, structurally supportive frame member;

a shield for the pointed arrow tips, positioned at one end of said frame member;

an arrow shaft support means supported on said frame member at a point spaced from said shield, for engaging and releasably supporting the shaft of each of said arrows; and compartmentalized retainer means within said shield including partition-like walls projecting between adjacent arrowheads to define compartments separating one arrowhead from another, thereby preventing noise during the withdrawal of each of said arrows from said quiver by preventing contact between adjacent arrowheads as they are withdrawn from the shield, said retainer means including a base wall in addition to said partition-like walls, said base wall defining a plurality of openings, each adapted to receive at least portions of an individual arrowhead inserted into such opening, said retainer means base wall defining a plurality of equally-spaced blade-receiving recesses extending radially outwardly from the periphery of each of said openings, and said retainer means base wall further defining a plurality of indexing slots each extending at least partially through said wall, said indexing slots extending outwardly from said openings in the same radial plane as said blade-receiving recesses but having a width less than that of the recesses and being dimensioned to resiliently grip said blades.

2. A quiver as defined by claim 1 wherein said shield comprises a cup-like member having an end wall and sidewalls, said end wall having a thickness substantially greater than the thickness of said sidewalls.

3. A quiver as defined by claim 1 wherein said arrow shaft support means comprises a resilient member having a plurality of shaft-receiving, generally rounded slots in the lateral edges thereof, said slots being generally C-shaped and of a size to positively engage and frictionally retain the shaft of an individual one of said arrows, said rounded slots being oriented so as to open in a direction which is generally toward the bowstring of a bow on which said quiver is mounted.

4. A quiver means mountable on a bow, comprising:

a main structural support comprising an elongated frame member;

a shield for arrow tips carried by said frame member near one end portion thereof;

arrow-retaining means carried by said frame member at a point spaced from said shield, for retaining a plurality of arrows;

said frame defining a quiver mount at a point medially along its elongated length; and a mounting bracket and means for securing said bracket to said bow, said bracket including means for releasably engaging said quiver mount defined by said frame member to releasably secure the frame member and thus the quiver itself to said bow without the use of hand tools, thereby providing quick manual detachment and mounting of the quiver, said mounting bracket and said quiver mount defined by said frame member each defining complementary portions of a slidably engageable tongue-and-groove structure having a pair of longitudinally-extending transversely-spaced channels, each of said channels being open at at least one end, said mounting bracket further including shiftable latch means comprising a leaf spring means carried on said bracket and resiliently movable from a first position for permitting interengagement of said tongue-and-groove structure to a second position for preventing disengagement of such structure accompanying removal of said frame member quiver mount from said mounting bracket.

5. A quiver as defined by claim 4 wherein said mounting bracket has a side surface and said leaf spring means includes a leaf spring element disposed along a side of said bracket.

6. A quiver as defined by claim 5 wherein said leaf spring element is secured to said bracket and lies flush along one side thereof.

7. A quiver as defined by claim 4 wherein said leaf spring means includes a portion disposed to overlie and block said tongue-and-groove structure in said second position to thereby block said structure and thereby prevent removal of the quiver from the mounting bracket and bow.

8. An arrowhead separator and containment means adapted for use with a quiver, comprising:

a compartmentalized, honeycomb-like member defined by a plurality of angularly interconnected generally planar interior walls forming a plurality of mutually separate compartments, each of said compartments having a width to receive only a single arrowhead, said member including a base wall disposed generally orthogonally to said interior walls and generally adjacent thereto, said base wall further including arrowhead holding means for resiliently holding an arrowhead, said arrowhead holding means including said base wall having a plurality of openings each aligned with one of said compartments, said openings having a size to receive the tip portion of a single arrowhead disposed within the aligned compartment, said base wall further defining a plurality of recesses extending radially from at least certain of said openings.

9. An arrowhead retainer as defined by claim 8 wherein arrowhead holding means further includes said base wall defining a plurality of blade-receiving slots extending outwardly from said openings a distance greater than but in the same radial plane as said recesses, said slots being narrower than said recesses and dimensioned to resiliently grip and hold the blades of an arrowhead.

10. An arrowhead retainer as defined by claim 9 wherein said recesses extend transversely into said base wall through only a portion of said wall.

11. An arrowhead retainer as defined by claim 8 further including at least one additional compartment; and a sponge-like element positioned within said additional compartment, said sponge-like element adapted to adsorb a quantity of animal-attracting scent.

12. A hunter's arrow quiver, comprising:

a support mountable upon a hunting bow, means carried on said support for holding and separately carrying individual arrows, means for protectively shielding the sharp tips on hunting arrows so held and carried, and means carried by said support for containing and carrying an animal-attracting scent compound in close proximity to the arrows so held and carried, said means for containing and carrying an animal-attracting scent compound including an absorbent element and means for retaining said element in place.

13. The hunter's arrow quiver of claim 12 wherein said means for retaining said absorbent element in place comprises at least two spaced wall portions, said element disposed between said wall portions and frictionally engaging the latter.

14. An arrow shaft holder construction for quivers and the like, comprising: a resilient member having notch-like openings extending inwardly of such member at locations along its outer periphery, said notch-like openings having a size and shape which will receive an arrow shaft, and retain the shaft within the opening; means defining a support shoulder having a surface with a shape complementary to a surface of said resilient member, said resilient member disposed adjacent said support shoulder with the complementary surfaces of each in contact with one another; at least one mounting aperture extending through said resilient member; a lug extending from said support shoulder into said mounting aperture, said lug having a terminal end spaced from said support shoulder and forming an abutment; an aperture extending longitudinally within said lug; said lug having a threaded portion, said threaded portion therefore being associated with and secured relative to said support shoulder; and a load-bearing means having an abutment disposed in alignment with said lug and bearing against the terminal end of the lug, together with a bearing surface at a fixed spacing relative to said abutment and in contact with the resilient member on a side thereof opposite said support shoulder, and a threaded member extending through the plane of said bearing surface and said abutment and engaging said threaded portion; said threaded member when tightened into said threaded portion carrying said bearing surface toward and against said resilient member and clamping the latter between said support shoulder and said bearing surface with a clamping force acting to compress the resilient member and constrict the said notch-like openings thereof so as to make the latter grip the arrow shaft increasingly, abutment of said terminal end of said lug with said bearing means abutment limiting such tightening of said threaded member thereby limiting the extent of clamping of said resilient member and limiting the constriction of the notch-like openings about the arrow shaft.

15. The arrow shaft holder construction of claim 14 wherein said support shoulder carries at least two of said lugs in fixed position relative to each other, said resilient member having a pair of said mounting apertures spaced and located to receive said lugs, whereby said lugs comprise locators for positioning said resilient member in a particular orientation relative to said support shoulder.

16. An arrow shaft holder construction for quivers and the like, comprising: a resilient member having an upper edge and a lower edge and having notch-like openings extending inwardly of such member at locations along its upper and lower edges, each of said notch-like openings having a size and shape which will receive an arrow shaft and frictionally grip and retain the shaft within the opening; means for mounting said member upon an archery bow in a position such that the arrows retained within said openings have their longitudinal axes generally parallel to one another and to the longitudinal axis of the bow and its bowstring and oriented such that each of said openings on said upper edge of said member are directed inwardly toward the user of the bow when the member is mounted on the bow, whereby arrows pulled laterally from said upper edge openings exit therefrom in a direction generally toward the position of an archer holding the bow in the shooting position.

17. An arrowhead separator and containment means adapted for use with a quiver and for insertion within a cup-like shield, said shield having an annular wall, comprising:

a compartmentalized member defined by a plurality of interior walls forming a plurality of mutually separate compartments, each of said compartments having a width to receive only a single arrowhead, said member including a base wall disposed generally orthogonally to said interior walls and generally adjacent thereto, said base wall having a plurality of openings each aligned with one of said compartments, said openings having a size to receive the tip portion of a single arrowhead disposed within the aligned compartment, said base wall further defining a plurality of recesses extending radially from at least certain of said openings, and a generally annular skirt-like wall peripherally surrounding the interior walls of said compartmentalized member, and extending from and generally perpendicular to said base wall whereby said annular skirt-like wall is disposed within and generally adjacent the annular wall of the shield.

* * * * *